US007519193B2

(12) United States Patent
Fretz

(10) Patent No.: US 7,519,193 B2
(45) Date of Patent: Apr. 14, 2009

(54) HEARING AID CIRCUIT REDUCING FEEDBACK

(75) Inventor: Robert J. Fretz, Maplewood, MN (US)

(73) Assignee: Resistance Technology, Inc., Arden Hills, MN (US)

( * ) Notice: Subject to any disclaimer, the term of this patent is extended or adjusted under 35 U.S.C. 154(b) by 554 days.

(21) Appl. No.: 10/931,683

(22) Filed: Sep. 1, 2004

(65) Prior Publication Data

US 2005/0047620 A1 Mar. 3, 2005

Related U.S. Application Data

(60) Provisional application No. 60/499,755, filed on Sep. 3, 2003.

(51) Int. Cl.
*H04R 25/00* (2006.01)

(52) U.S. Cl. ..... 381/312; 381/318; 381/317; 381/316; 381/71.8; 381/57

(58) Field of Classification Search ..... 381/318, 381/312, 317, 316, 320, 328, 71.8, 56, 57, 381/326, 56.57
See application file for complete search history.

(56) References Cited

U.S. PATENT DOCUMENTS 3,538,259 A * 11/1970 Brahman ..... 381/9
5,091,952 A 2/1992 Williamson et al. ..... 381/68.2
5,937,070 A * 8/1999 Todter et al. ..... 381/71.6
6,072,884 A 6/2000 Kates ..... 381/318
6,173,063 B1 1/2001 Melanson ..... 381/318
6,219,427 B1 4/2001 Kates et al. ..... 381/318
6,434,246 B1 8/2002 Kates et al. ..... 381/312
6,434,247 B1 8/2002 Kates et al. ..... 381/312
6,498,858 B2 12/2002 Kates ..... 381/318
2003/0053647 A1 3/2003 Kates ..... 381/318
2003/0138110 A1 * 7/2003 Sato ..... 381/61

OTHER PUBLICATIONS

DSPfactory, "Toccata Plus: Flexible DSP system for hearing aids," pp. 1-3, Jul. 23, 2004, website http://www.dspfactory.com/products/toccata plus.html.

* cited by examiner

*Primary Examiner*—Wayne R Young
*Assistant Examiner*—Dionne H Pendleton
(74) *Attorney, Agent, or Firm*—Westman, Champlin & Kelly, P.A.

(57) ABSTRACT

A hearing aid circuit includes a correlation detector that detects correlation at a feedforward path input and that provides a correlation output to a phase shifter. The phase shifter introduces a phase shift along a feedforward path. A phase measurement circuit measures a phase shift at a feedforward path input, and provides a phase measurement output to an internal feedback processor. The internal feedback processor adjusts internal feedback as a function of the phase measurement to suppress coupling of external audio feedback along the feedforward path.

18 Claims, 10 Drawing Sheets

HEARING AID CIRCUIT REDUCING FEEDBACK

CROSS-REFERENCE TO RELATED APPLICATION

This application claims the benefit of U.S. Provisional Application 60/499,755 filed on Sep. 3, 2003 for inventor Robert J. Fretz and entitled Feedback Cancellation.

FIELD OF THE INVENTION

The present invention relates generally to hearing aid circuits, and more particularly but not by limitation to hearing aid circuits that correct feedback.

BACKGROUND OF THE INVENTION

In hearing aid circuits, there is a problem with sound coupling along external feedback paths through the air. The external feedback generates annoying whistles and audio distortion. The external auditory canal, for example, is not sealed by the hearing aid. There is an external feedback path that couples sound produced by a hearing aid receiver through the auditory canal to a hearing aid microphone.

In some hearing aid designs, a portion of the hearing aid is positioned in the ear canal and includes a vent that contributes to the gain of the external feedback path. In other hearing aid designs, the sound from the receiver couples via a narrow tube into the auditory canal, and there is a feedback path in the space around the narrow tube. Frequently, jaw motion can change the shape of the ear canal, opening up additional air paths that can contribute to the gain of the external feedback path. When a sound reflecting object such as a telephone earpiece is brought near the hearing aid, sound reflections can also contribute to feedback path gain. The characteristics of the external feedback path are variable and real time correction is desired. Various feedback cancellation circuits are known, as shown in FIG. 1 for example. However these feedback cancellation circuits typically have problems distinguishing between sounds from the environment, such as musical notes, and actual feedback.

A hearing aid circuit is needed that can distinguish feedback from environmental sounds, and that can improve cancellation of feedback without unduly distorting environmental sounds.

SUMMARY OF THE INVENTION

Disclosed is a hearing aid circuit that provides amplification along a feedforward path in an environment subject to external audio feedback path. The hearing aid circuit comprises a phase shifter that introduced a phase shift along the forward path as a function of correlation at a feedforward path input.

The hearing aid circuit comprises a phase measurement circuit that measures a phase shift at the feedforward path input. The phase measurement circuit provides a phase measurement output.

The hearing aid circuit comprises an internal feedback processor that receives the phase measurement output. The internal feedback processor adjusts internal feedback as a function of the phase measurement to suppress coupling of the external audio feedback along the feedforward path.

DETAILED DESCRIPTION OF ILLUSTRATIVE EMBODIMENTS

Hearing aid feedback is a widespread problem with hearing aids and is a source of annoyance to the user and to near-by individuals. The problem comes from the fact that there is a positive feedback loop formed with the forward gain of the hearing aid and the return through the hearing aid vent or leakage around the device. Generally, when the total forward gain is greater then the attenuation of the return, path oscillation occurs.

In a PRIOR ART hearing aid circuit described below in connection with FIG. 1, hearing aid feedback is not adequately corrected and presents problems. However, in the embodiments described below in connection with FIGS. 2-9, the problem of hearing aid feedback is substantially reduced.

In the embodiments described below in connection with FIGS. 2-9, a hearing aid circuit detects correlation in a received audio input, and then introduces a small phase shift in a forward processor. A small phase shift measurement algorithm measures a phase shift at an input to the forward processor in order to distinguish whether the correlation is from hearing aid feedback or from a sound from the environment. When the correlation is found to be caused by hearing aid feedback, a feedback processor is adjusted to rapidly and substantially reduce the hearing aid feedback. When the correlation is found to be caused by a sound from the environment, the adjustment to the feedback processor can be modified in order to avoid distorting the sound from the environment. The hearing aid circuit can be conveniently implemented using a digital signal processor.

Figure 1:
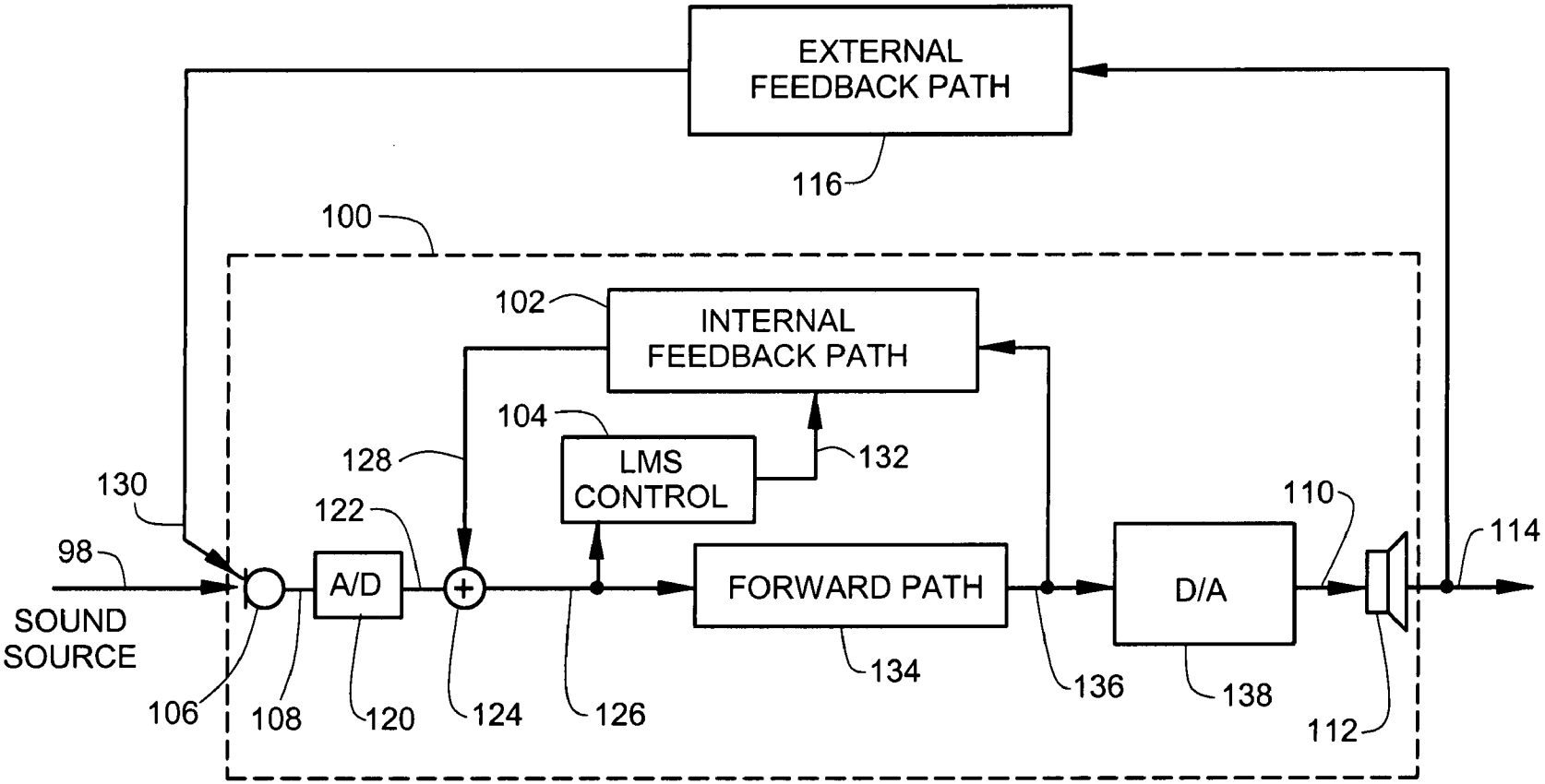
FIG. 1 PRIOR ART
FIG. 1 illustrates a PRIOR ART block diagram of a hearing aid with an adjustable internal feedback path controlled by a least mean squared (LMS) algorithm.

The PRIOR ART hearing aid circuit 100 is illustrated in FIG. 1. The hearing aid circuit 100 includes an adjustable internal feedback path 102 controlled by a least mean squared (LMS) controller 104. A microphone 106 senses sounds 98 and converts the sounds 98 to an audio frequency input 108 in the hearing aid circuit 100. The hearing aid circuit 100 amplifies and filters the audio input 108 and provides an audio frequency output 110 that couples to a receiver 112. The hearing aid receiver 112 converts the audio frequency output to an audible sound 114 that is coupled along the user's external auditory canal to the user's ear drum. As explained above, the external auditory canal is not sealed by the hearing aid 100. There is an external feedback path 116 that couples sound produced by the receiver 112 through the auditory canal to the microphone 106.

The hearing aid circuit 100 introduces a first delay in reproducing sounds. Due to the limited speed of sound in air, the external feedback path 116 introduces a second delay in feeding sounds from the receiver 112 back to the microphone 106 through the air. When the first and second delays add up to 360 degrees at a frequency within the amplification range of the hearing aid circuit 100, and when the gain, at that frequency, around a loop through the hearing aid circuit 100 and the external feedback path 116 is one or more, then a high amplitude, sustained oscillation can occur. This sustained oscillation is referred to as "hearing aid feedback" and is recognizable as an annoying feedback, squeal or chirp that can be heard by the user or by others nearby.

Some expedient approaches to reducing the hearing aid feedback problem are to reduce the gain of the hearing aid circuit 100 by turning down a volume control, or to adjust the hearing aid to fit tighter in the ear canal or to reduce the vent size. These expedients are often unsatisfactory solutions since the forward gain is desired and a tighter fitting hearing aid is less comfortable.

Beside these expedients, another approach, illustrated in FIG. 1, is the adjustment of the internal feedback path 102 so that the combined feedback (net feedback) of both the external feedback path 116 and the internal feedback path 102 is reduced and does not meet the conditions for hearing aid feedback oscillations to occur.

The hearing aid circuit 100 includes an analog-to-digital converter 120 that receives the audio frequency input 108 from the microphone 106 and produces a digital audio output 122. The digital audio output 122 is coupled to a summing circuit 124. Internal feedback 128 from the internal feedback path 102 is also coupled to the summing circuit 124. The summing circuit 124 provides a net sum output 126 that is a sum of the digital audio output 122 and the internal feedback 128. The term "summing circuit" as used in this application refers broadly to include circuits that add or subtract. The net sum output 126 includes first, second and third components. The first component represents sound from the sound source 98. The second component represents sound feedback 130 from the external feedback path 116. The third component represents the internal feedback 128.

The least mean squared (LMS) control circuit 104 senses the net sum output 126 and provides a control output 132 to the internal feedback path 102. The control output 132 adjusts the characteristics of the internal feedback path 102 in an effort to provide an internal feedback 128 that substantially cancels or reduces the power of the sound feedback component to reduce problems with hearing aid feedback. The internal feedback path 102 is typically a FIR filter.

While the arrangement in FIG. 1 does have an advantage in that it reduces hearing aid feedback without reducing forward gain (amplification) along a forward path 134, it can also add distortion and fail to cancel feedback.

In the limited circumstances where the feedback signal 130 at the microphone is not correlated with the sound source 98 at the microphone 106, then the LMS algorithm can work well in correcting hearing feedback. In many other circumstances, however, the LMS algorithm does not work properly.

There are many situations where there is, in fact, a high correlation of the environmental sound source 98 with the feedback signal 130 at the microphone. If the sound source 98 is periodic, then the feedback signal 130 correlates with the input. Musical inputs are a common example of a periodic sound source. Musical tones can last for a second or more which is much longer than the 2 to 12 ms that is typical of most hearing aid feedback loop delays. The result of this correlation is that the LMS algorithm adjusts the FIR filter to reduce the input signal, which in turn results in a misadjusted FIR filter. The LMS algorithm doesn't differentiate between correlation from an environmental sound and correlation from hearing aid feedback. If the FIR filter becomes sufficiently misadjusted then a true feedback oscillation will begin to build resulting in a very annoying artifact.

This problem with the LMS algorithm has been known for a long time and attempts have been made to try to mitigate the problem. One attempt has been to allow adjustment of the FIR filter only extremely slowly or not when the user selects a "music mode" or only during initial fitting of the device. The weakness of this attempt is that there is poor or no compensation for real time changes in the feedback that occur from common situations such as jaw motion or a telephone being brought near the ear. Another attempt is to only allow the FIR a limited range of adjustment. This, however, also limits the range of correction that is possible. Another attempt is to inject pseudo random noise into the output and look for that noise in the input. This works if the noise has a high enough amplitude, but adding noise is annoying to a hearing aid user.

Still another attempt is to add a time varying delay in the forward path that is long enough to break up the correlation of the feedback signal with the input. The problem with this attempt is that it requires the delay to change more rapidly than the FIR is corrected and for the phase to be changed by at least 180 degrees, typically more than 360 degrees. In practical situations this large rapid phase change results in a sound artifact that is undesirable. These problems with the PRIOR ART circuit 100 are overcome as described below in connection with examples in FIGS. 2-9.

Figure 2:
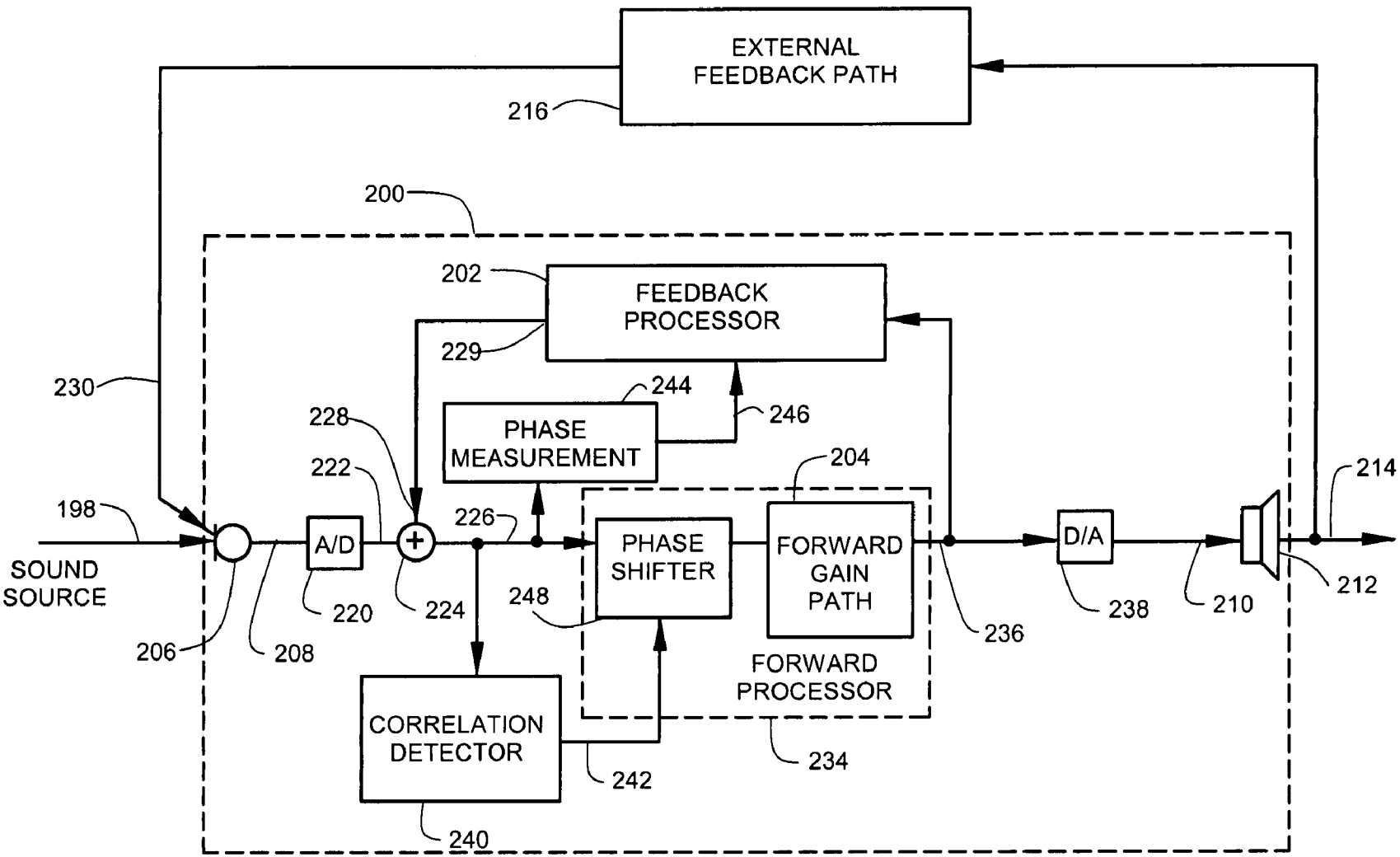
FIG. 2 illustrates a block diagram of a first embodiment of a hearing aid circuit that includes an adjustable internal feedback path controlled by a small phase shift measurement (SPM) algorithm.

FIG. 2 illustrates a block diagram of a first embodiment of a hearing aid circuit 200 that includes an adjustable internal feedback path controlled by a small phase shift measurement (SPM) algorithm. The SPM algorithm is able to differentiate true hearing aid feedback from highly correlated sounds from the environment. The SPM algorithm provide fast internal feedback correction for hearing aid feedback without distorting highly correlated environmental sounds. Such fast internal feedback correction could not be used in the PRIOR ART arrangement in FIG. 1 without distorting the environmental sounds. The arrangement shown in FIG. 2 provides the user with a desired range of amplified environmental sounds without the disadvantages of high hearing aid feedback and distortion.

The hearing aid circuit 200 provides amplification along a feedforward path 234 in an environment that is subject to external audio feedback path 216. A correlation detector 240 detects correlation at a feedforward path input 226 and generates a correlation output 242. A phase shifter 248 receives the correlation output 242. The phase shifter 248 introducing a phase shift along the forward path 234 as a function of the correlation output 242. In one preferred arrangement, the phase shift has a phase shift amplitude that is inversely related to an amplitude of the correlation over an operating range.

A phase measurement circuit 244 measures a phase shift at the feedforward path input 226. The phase measurement circuit provides a phase measurement output 246. An internal feedback processor 202 receives the phase measurement output 246 and adjusts internal feedback to suppress coupling of the external audio feedback along the feedforward path.

The hearing aid circuit 200 comprises a summing circuit 224 that receives an audio output 222. The audio output 222 includes audio from a sound source 198 and audio from audio feedback 230. The summing circuit 224 also has a second summing input 228 and a net sum output 226. The net sum output 226 serves as a feedforward path input. A forward processor 234 (also called feedforward path 234) receives the net sum output (feedforward path input) 226 and provides a processed output (feedforward path output) 236.

The internal feedback processor 202 receives the processed output 236 and provides a feedback output 229 to the second summing input 228. The correlation detector 240 couples to the forward processor 234 along line 242 (also called correlation detector output 242) to provide a small phase change in the processed output 236 as a function of detected correlation in the net sum output 226. The phase measurement circuit 244 measures phase change in the net sum output 226 and provides the phase measurement output 246 that makes an adjustment of the feedback processor 202. The adjustment reduces net feedback at the net sum output 226. The net feedback is the sum of feedback output 229 and audio feedback 230 at the net sum output 226. The phase measurement circuit 244 can sense phase change in the net sum output 226 by a direct connection to the net sum output 226 as illustrated in FIG. 2, or alternatively, the phase measurement circuit 244 can be connected to the output 242 of the correlation detector 240 in order to measure phase change on a filtered version of the net sum output 226 as it appears at the output 242 of the correlation detector 240.

In one preferred arrangement, the hearing aid circuit 200 comprises a hearing aid circuit, and the adjustment reduces net hearing aid feedback at the net sum output 226. A microphone 206 senses sounds 198 and converts the sounds 198 to an audio frequency input 208. The circuit 200 includes an analog-to-digital (A/D) converter 220 that receives the audio frequency input 208 from the microphone 206 and produces the digital audio output 222. The circuit 200 amplifies and filters the audio input 208 and provides an audio frequency output 210 to a receiver 212. The receiver 212 converts the audio frequency output 210 to an audible sound 214 that is coupled along the user's external auditory canal to the user's ear drum. The hearing aid couples to the external feedback path 216 that provides the audio feedback 230. The processed output 236 also couples to a digital-to-analog (D/A) converter 238 that provides the audio frequency output 210 that drives the receiver 112. The D/A converter 238 typically receives a stream of digital words that represent amplitude and provides an analog output to the receiver 212. The D/A converter 238 is preferably a bit stream D/A converter. The microphone 206 and the receiver 212 can be part of the circuit 200, as illustrated, or can be separately mounted components that are connected to the circuit 200.

Figure 3:
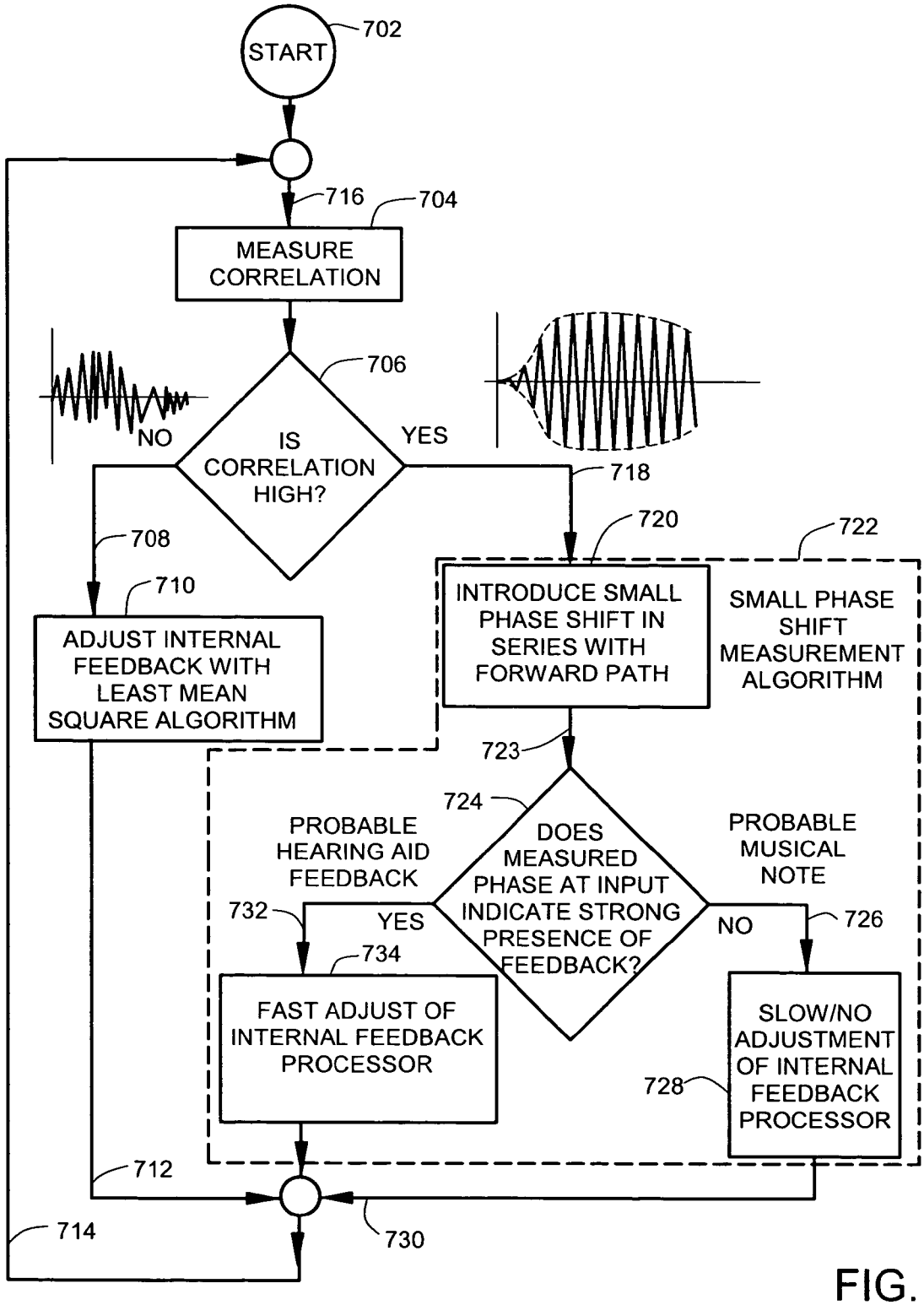
FIG. 3 illustrates an exemplary flow chart of a small phase shift measurement method of adjusting an internal feedback path in FIG. 2.

FIG. 3 illustrates a flow chart of examples of adjusting an internal feedback path in the arrangement shown in FIG. 2. It will be understood by those skilled in the art that the flow chart in FIG. 3 illustrates simplified examples of instances where there is a single component of audio input such as non-correlated speech, hearing aid feedback, or a musical note, taken one at a time. It is to be understood that such simplified examples are presented for the purpose of illustration, and that environmental and feedback conditions are typically more complex, and that the algorithm illustrated in FIG. 3 is capable of operating incrementally depending on the complex pattern actually present. For example, when both a musical note and hearing aid feedback are present, the internal feedback can be adjusted in increments so that hearing aid feedback is cancelled in increments until the remaining correlation is predominantly a result of the musical note.

In FIG. 3, processing starts at start 702 and continues to a correlation measurement 704. Algorithm flow then continues to decision block 706 which tests whether measured correlation is above a correlation threshold. If the correlation is below the threshold, then program flow continues along line 708 to action block 710. At action block 710, internal feedback is incrementally adjusted using a least mean square algorithm, and then algorithm flow continues along lines 712, 714, 716 to the next cycle of correlation measurement at 704.

If the correlation is above the threshold at decision block 706, the algorithm flow continues along line 718 to action block 720, which is part of the small phase measurement algorithm 722. At action block 720, a small phase shift is introduced at the correlation frequency, and algorithm flow continues along line 723 to decision block 724.

At decision block 724, if the phase shift measured after a loop time delay is below a phase shift threshold, then algorithm flow continues along line 726 to an optional slow adjustment 728 of the internal feedback path, or algorithm flow continues, with no adjustment made, along lines 730, 714, 716 to the next cycle of correlation measurement 704. At decision block 724, if the phase shift measured after a loop time delay is above a phase shift threshold, then algorithm flow continues along line 732 to action block 734, which performs a fast internal feedback adjustment to reduce hearing aid feedback. The amount and speed of the adjustment is preferably adjusted proportional to the amount of phase shift measured. After completion of action block 734, algorithm flow continues along lines 714, 716 to the next cycle of correlation measurement at 704. The cycle of correlation detection through coefficient update is preferably from about 20 to 40 milliseconds. After one cycle is completed, a new cycle is started. The adaptation runs continuously, allowing the system to respond to changes that occur in the external feedback path such as when objects are moved close to the ear or the fit of the aid in the ear canal changes. Examples of the types of phase shifts that can be introduced at action block 720 are described below in connection with FIGS. 4A, 4B, 4C.

Figure 4A:
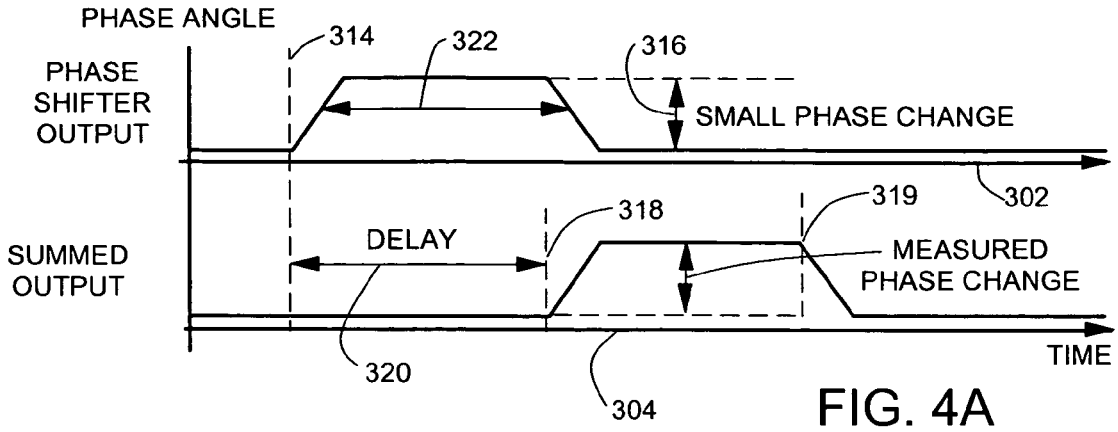
FIGS. 4A, 4B, 4C illustrate timing diagrams of small phase shifts at a processed output and at a net sum output when there is external feedback that produces oscillation.
Figure 4B:
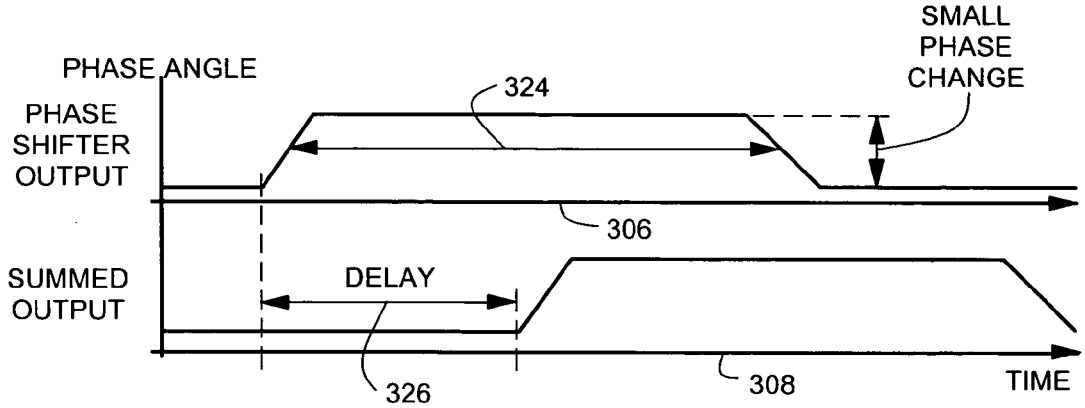
Figure 4C:
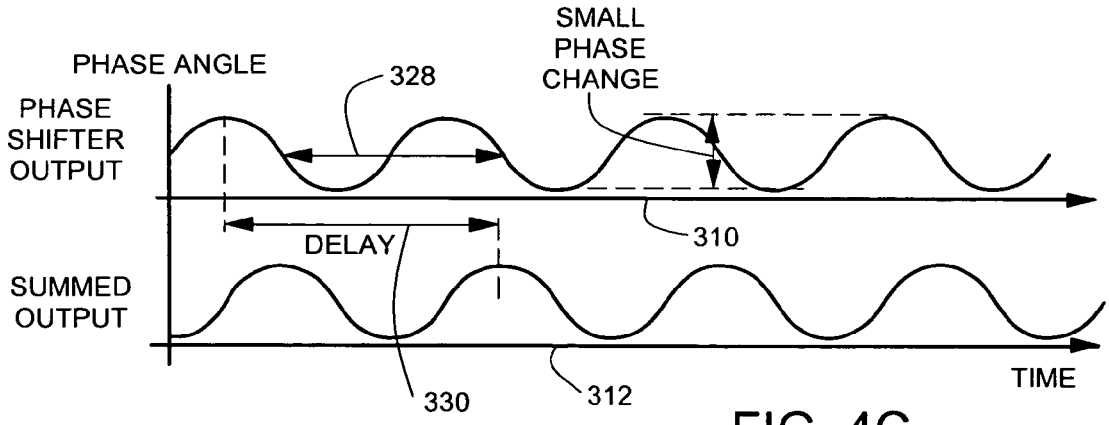

FIGS. 4A, 4B, 4C illustrate exemplary timing diagrams of small phase shifts at phase shifter outputs and at net sum outputs (such as net sum output 226 in FIG. 2). In FIGS. 4A, 4B, 4C, horizontal axes 302, 304, 306, 308, 310, 312 represent time, and vertical axes represent phase angles for the processed output and the net sum output.

In FIG. 4A, a temporary time duration 322 of the small phase change 316 is approximately the same length of time as the delay 320 and is approximately a ramped step change. In FIG. 4B, a temporary time duration 324 is longer than the delay 326 and is approximately a ramped step change. In FIG. 4C, the small phase change varies sinusoidally with a sinusoidal period 328 that is shorter than a delay 330, but longer than a period of the correlation signal. Waveforms other than those illustrated in FIGS. 4A, 4B, 4C can also be used to be compatible with the particular circuit or algorithm that is used for sensing small phase change.

In the examples illustrated in FIG. 4A 4B, 4C, a correlated signal has been detected by the correlation detector 240 (FIG. 2) and the correlation detector 240 has coupled a signal along line 242 (FIG. 2) to the phase shifter 248 (FIG. 2). The phase shifter 248 introduces a small phase change, and the small phase change propagates through the forward gain path 204 (FIG. 2) and the feedback paths and appears at the summed output 226. The term "small phase change" means a phase change that is so small that it does not affect the forward path time delay enough to directly cause hearing aid feedback to stop. The amplitude of the small phase change 316 in FIG. 4A is preferably in the range of 10-90 electrical degrees at the correlation frequency. A small phase change of about 20 degrees is most preferred, and provides enough phase change amplitude for reliable measurement of phase change without introducing undesirable artifacts in the audible sound output 214. The human ear has a low sensitivity to small phase change so the inserted phase shift is measurable by the phase measurement circuits but it has a very tiny, usually undetectable, artifact to the listener.

The small phase change present at the feedforward output 236 is coupled (fed back) through the external feedback path 216 to the microphone 206 in FIG. 2. The small phase change 316 is also coupled (fed back) through the feedback processor 202 to the summing circuit 224 in FIG. 2. If the internal feedback processor 202 cancels out the external feedback path 216 then there is no net feedback at 226. The phase changes of the two paths will also cancel. The result is that no phase change will be measured by the phase measurement circuit 244. When a small phase shift is not measured, the source of the correlated signal is presumed to be a correlated sound from the environment, so adjustments to the feedback processor 202 are made slowly or not at all.

On the other hand, if the internal feedback processor 202 does not cancel out the external feedback path 216 then there is a net feedback at 226. The result will be that the small phase change will appear at 226. When the small phase shift is measured by the phase measurement circuit 244, the phase measurement circuit 244 adjusts the feedback processor 202 to provide feedback at output 229 that tends to reduce or cancel the external feedback. The cancellation process preferably occurs incrementally over several repetitive cycles of correlation measurement, to reduce undesired audio artifacts from the cancellation process.

The SPM algorithm is distinct from the use of a varying delay in the forward path. The varying delay approach uses an LMS algorithm but with the time varying delay added to break up the correlation of the feedback signal with the input. To accomplish this, the delay must change the phase of the signal by at least 180 degrees so that which was in-phase becomes out-of-phase.

Varying the delay must occur in a time shorter than the speed of the LMS adaptation. This typically means that either the adaptation must occur slower than desired or that the varying delay occurs so fast that it produces undesirable noticeable artifacts. The SPM is fundamentally different than varying delay. Rather than using delay to break up the feedback path, the SPM algorithm uses the small phase change as a non-audible probe signal superimposed on the normal operation of the hearing aid circuit.

Figure 5:
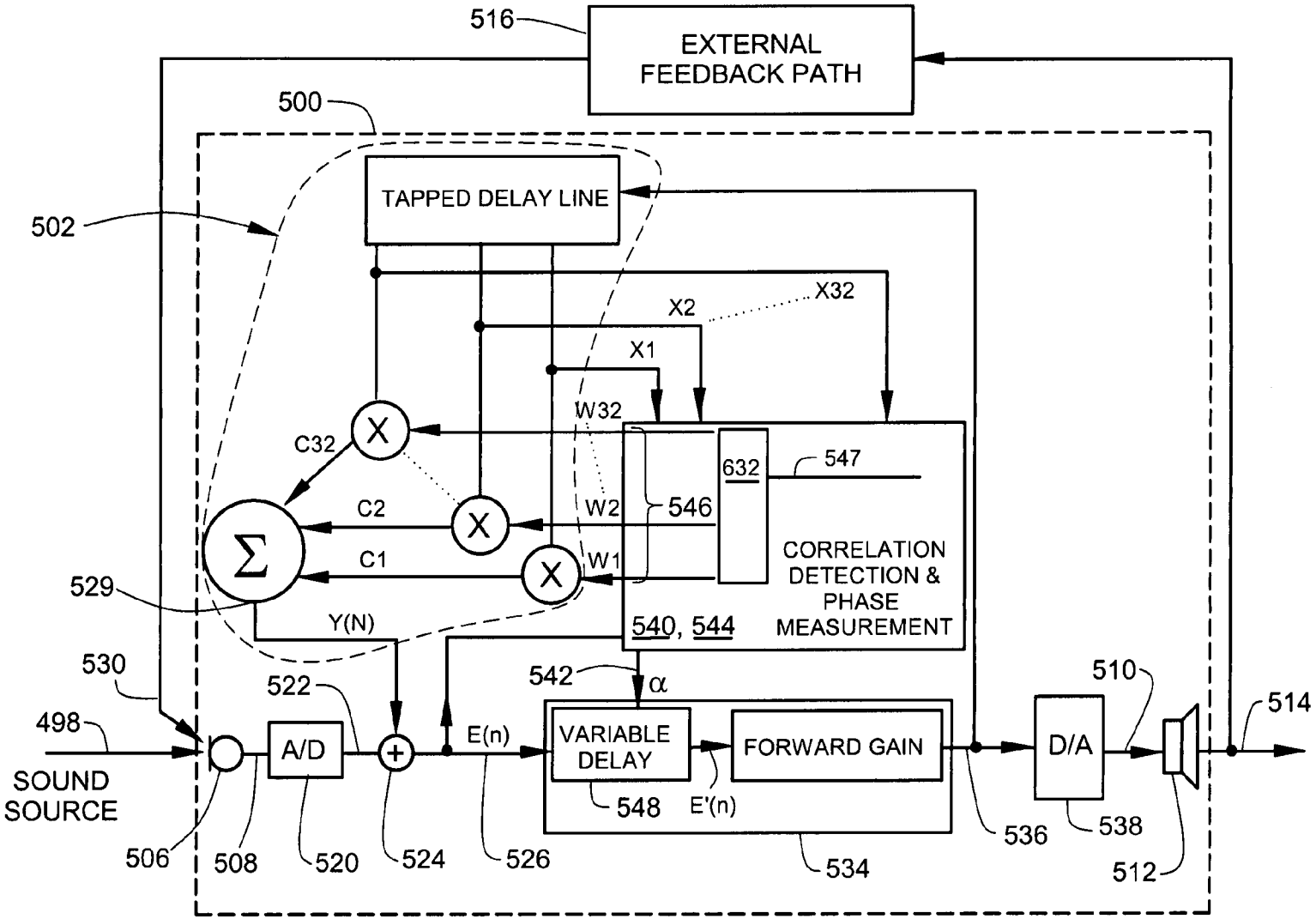
FIG. 5 illustrates a block diagram of a second embodiment of a hearing aid circuit that includes an adjustable internal feedback path controlled by an SPM algorithm.

FIG. 5 illustrates a block diagram of a second embodiment that includes an SPM algorithm. This embodiment uses very simple circuit elements. The correlation detector 540 and the phase measurement circuit 544 are modification of standard LMS elements. The phase shifter 248 is implemented with a small variable delay.

The hearing aid circuit 500 provides amplification along a feedforward path 534 in an environment that is subject to an external audio feedback path 516. A correlation detector 540 (which is combined with a phase measurement circuit 544) detects correlation at a feedforward path input 526 and generates a correlation output 542. A variable delay phase shifter 548 receives the correlation output 542. The variable delay phase shifter 548 introduces a phase shift along the forward path 534 as a function of the correlation output 542. In a preferred arrangement, the phase shift has a non-interfering amplitude that is small enough to be imperceptible to the user.

The phase measurement circuit 544 (which is combined with the correlation detector 540) measures a phase shift at the feedforward path input 526. The combined circuit 540, 544 can be seen as an LMS circuit that is modified to include the additional features of detecting correlation and measuring phase. The phase measurement circuit 544 provides a phase measurement output 546. An internal feedback processor 502 receives the phase measurement output 546 and adjusts internal feedback to suppress coupling of the external audio feedback along the feedforward path.

A feedforward output 536 of the forward path 534 is coupled to D/A converter 538. D/A converter 538 provides an analog output 510 to receiver 512, and the receiver 512 produces a sound output 514. A microphone 506 receives sound 498 from the environment and also receives feedback sound 530. The microphone 506 couples an audio frequency input 508 to an A/D converter 520. The A/D converter 520 couples a digital audio output 522 to a summing node 524. The summing node 524 also receives an internal feedback output 529. The internal feedback is explained in more detail below in connection with FIG. 6.

Figure 6:
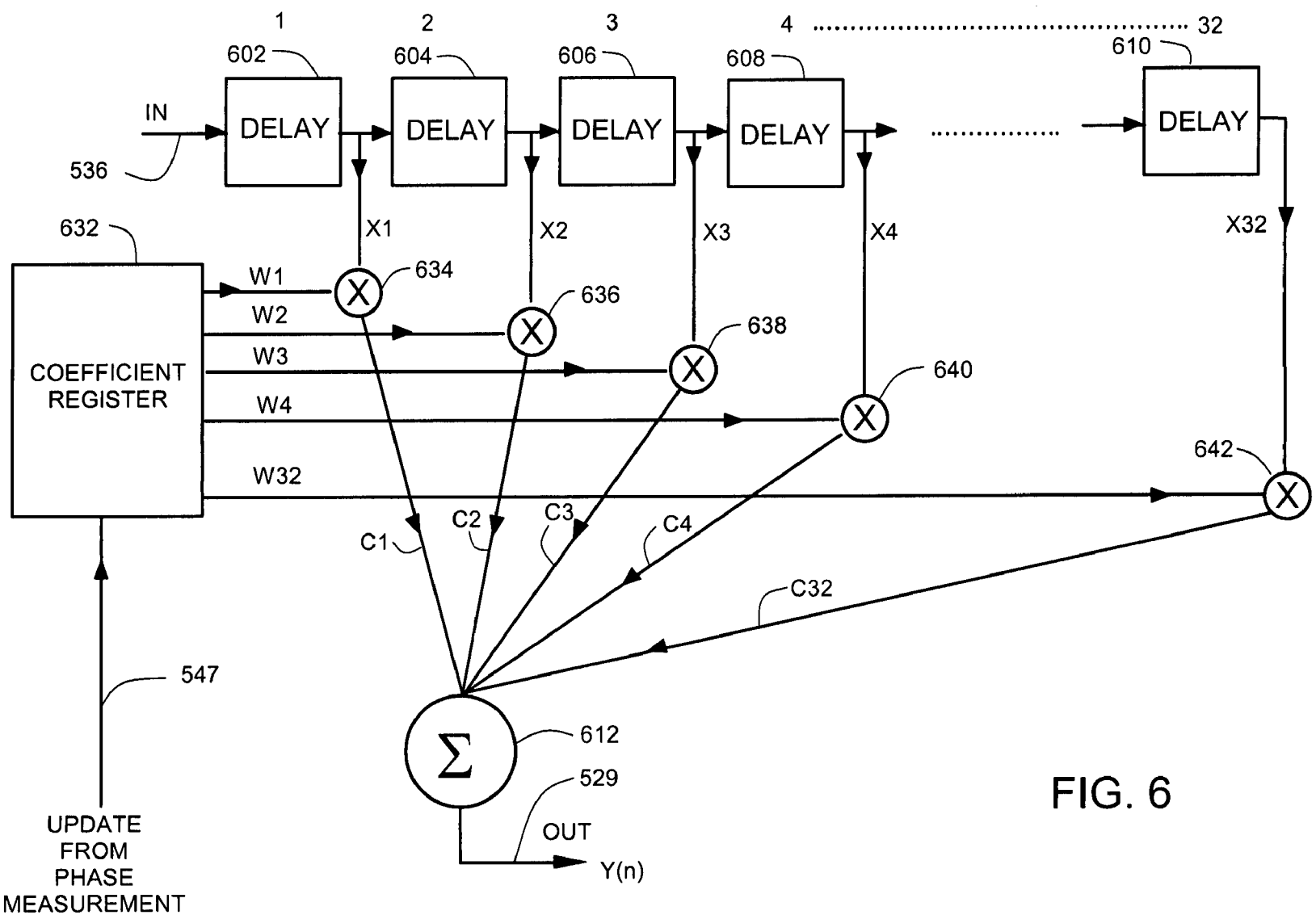
FIG. 6 illustrates a FIR filter useful in the hearing aid circuit of FIG. 5.
Figure 7:
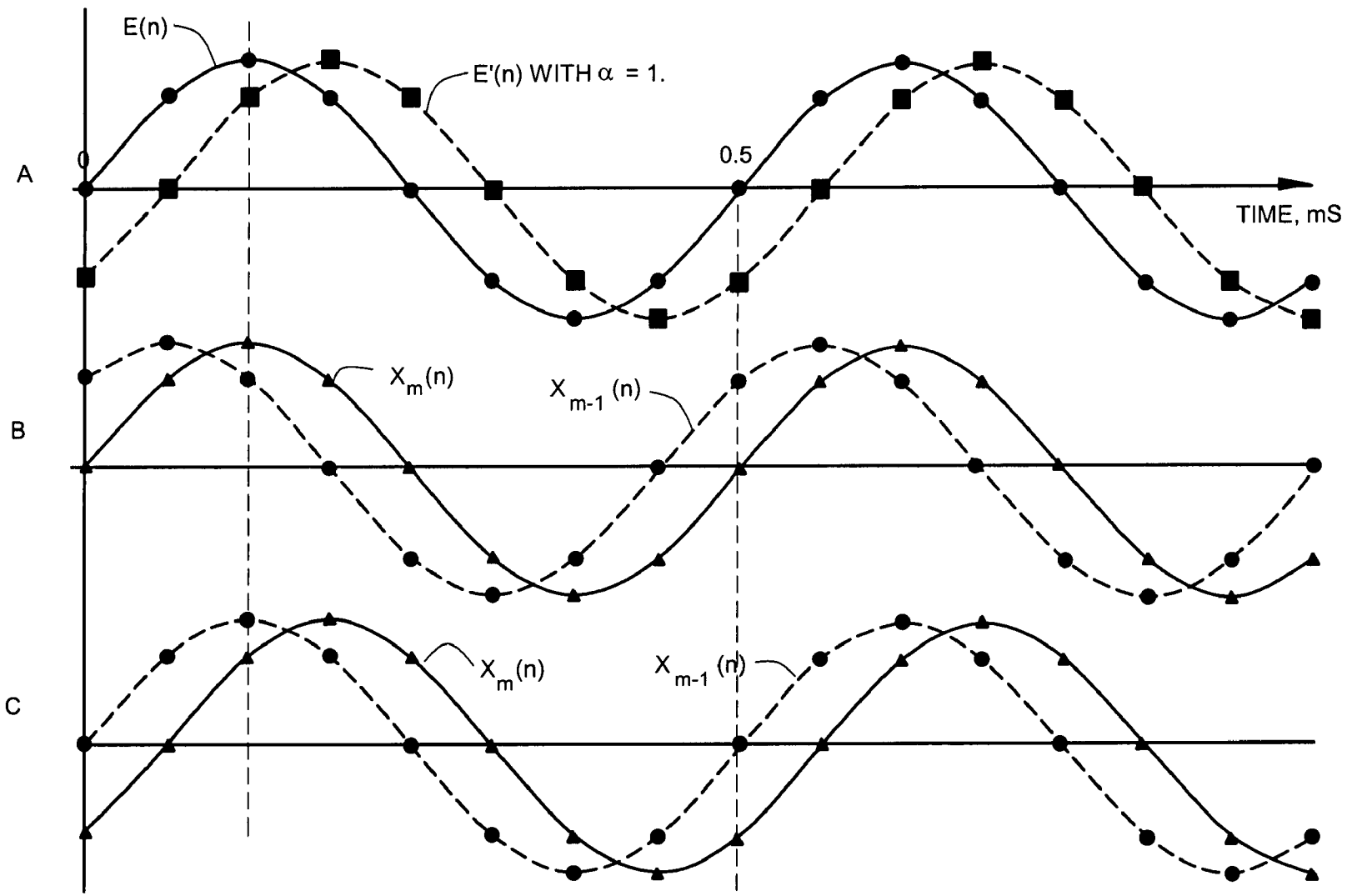
FIG. 7 illustrates an exemplary timing diagram for the hearing aid circuit shown in FIG. 5.

FIG. 6 illustrates the internal feedback shown in FIG. 5. FIG. 6 illustrates an internal feedback arrangement that includes cascaded delay elements 602, 604, 606, 608, . . . , 610 that produce delayed outputs X1, X2, X3, X4, . . . , X32. A coefficient register 632 (which is part of the phase measurement circuit 544 in FIG. 5) provides weighting outputs W1, W2, W3, . . . W32. The coefficient register 632 receives updates 547 from a phase measurement. Multipliers 634, 636, 638, 640, 642 combine pairs of Xn, Wn outputs to produce filter outputs C1, C2, C3, . . . C32. The filter outputs C1, C2, C3, C4, . . . C32 are added at a summing node 612 to forms a weighted sum of the delayed outputs. The summing node 612 generates an output Y(n) 529. The weighted output 529 is coupled to the summing node 524 in FIG. 5.

With a conventional LMS algorithm, coefficients wk (FIG. 6), would be used with the tapped delay outputs $x_k$ of a tapped delay line to form the sum shown in Equation 1:

$$y(n) = \sum_{i=0}^{k} x_i(n) \cdot w_i(n) \qquad \text{Equation 1}$$

where the $w_i$'s are updated according to Equation 2:

$$w_i(n+1) = w_i(n) - \mu \cdot e(n) \cdot x_i(n) \qquad \text{Equation 2}$$

where μ=conversion rate coefficient and e(n) is the signal 526. In some descriptions of LMS, the minus sign in Equation 2 may appear as a plus sign when there are different polarities and/or when a subtracting circuit is used in place of a summing circuit.

Unlike conventional LMS algorithms, in the embodiment of FIG. 5, the "$e(n) \cdot x_i(n)$" terms form the basis of a correlation detector. For the SPM algorithm, the $w_i(n)$ terms are not always updated as in Equation 2. Instead, product terms $x_i(n) \cdot e(n)$ serve the function of a correlation detector as shown in Equation 3:

$$CorrD_i(n) = \frac{1}{L}\sum_{l=0}^{L} x_i(n-l)\cdot e(n-l) \quad \text{Equation 3}$$

where L is a block of data to average over, typically 4 to 32 data samples and "i" corresponds to the delay elements 602, 604, 606, 608, 610 of FIG. 6. In general terms, the CorrD's are averages of the products of x and w. If one or more CorrD becomes large, then there is a high correlation. "Large" is in comparison to a long term average of e and x. Alternatively, "large" can be judged as a condition where $CorrD_i(n)$ is large for a few i's and small for other i's.

If the correlation is found to be small, then the system can revert to a normal LMS update of the "w" coefficients as in Equation 2. This update is best done slowly since the low correlation indicates no oscillation is present. Therefore, there is no need for a fast coefficient change and slow changes keeps the coefficients optimized and prevents any perceptible sound artifacts.

If a correlation term is found to be large, then there is an uncertainty to be resolved about what to do regarding the "w" coefficients. The high correlation could be due to a change in the external feedback path in which case the coefficients should be quickly updated using the normal LMS procedure. On the other hand, the large correlation could be due to a correlation in the input signal itself. Music, warning buzzers and the like have this correlation. For this latter case, the coefficients should not be changed at all or only very slowly. Using the LMS in this condition will serve to cancel some of the input and in the process misadjust the internal feedback path. As mentioned above, this uncertainty has been a weakness in the prior use of LMS algorithms.

However, with the SPM algorithm, the uncertainty is resolved by the use of a phase shift inserted into the forward path. In the embodiment shown in FIG. 5 the phase shift is implemented as a simple variable delay. Other phase shift implementations, such as an all-pass filter, could also be used. An all-pass filter allows the phase to be changed in only higher frequencies where feedback is known to occur in hearing aids. A variable delay has the advantage that it is simple to implement and analyze. The phase shifter can be further simplified by making it a delay that varies only one sample time as shown in Equation 4:

$$e'(n)=(1-\alpha)\cdot e(n)+\alpha\cdot e(n-1) \quad \text{Equation 4}$$

where: e'(n)=the output of the shifter
e(n)=the input to the shifter
$\alpha$=variable delay control from 0 to 1

In use, $\alpha$ would change from 0 to 1 gradually over about 1 millisecond, then remain at 1 for about 6 milliseconds, then ramp back down to 0 over 1 millisecond. An example of the delay with $\alpha$=1 is shown e'(n) in FIG. 7A for a 2 kHz sinusoid with a 16 kHz sampling frequency.

The uncertainty described above can be understood by considering the 2 kHz waves shown in FIGS. 7A,B,C. In this example, without the phase shift, one particular $x_m(n)$ correlates perfectly with e(n) as shown in FIG. 7B. Because of the high correlation, the CorrDi(n) of Equation 3 would be high for i=m. Responding to this high correlation, the algorithm would apply the phase shift. A phase shift of one sample interval is applied as shown in Equation 4.

Consider first the condition where the correlation is due to a net feedback causing oscillation at 2 kHz. In that condition the same $x_m(n)$ still correlates perfectly with E(n) because the same $m^{th}$ tap of the FIR filter needs to be corrected to stop the feedback. This is shown in FIG. 7B. Contrast FIG. 7B with an opposite condition in FIG. 7C where there is not net feedback and the correlation is due to a 2 kHz input signal. Here, when the phase shift is applied, e(n) does not change and the x(n)'s are delayed by the variable delay. Here $x_{m-i}(n)$ is the tapped signal that correlates best with e(n). Hence the shift of highest correlation from $m^{th}$ to $(m-1)^{th}$ tap indicates that the input signal is the source of the correlation. In this implementation, the location of the tap number with the highest correlation forms the phase measurement element.

If the tap of the highest correlation does not change, as in FIG. 7B, the LMS update of coefficients proceeds quickly. Specifically this would be Equation 2 with a relatively large $\mu$. On the other hand if there is a shift in the tap with the highest correlation, then the update would be stopped or $\mu$ set very mall.

The phase shift, in this example, is a small phase shift from 0 to 45 degrees then back to 0. Some conventional algorithms use variable delay elements to break up the correlation of input signals. The problem with the conventional algorithms is that typically 360 degrees or more shift is needed. The much smaller phase shift of the SPM algorithm results in large reduction in perceptual artifact. The small phase shift works with the SPM since the phase shift is not used to breakup the correlation but rather to allow measurement of the phase at the input and the appropriate decisions to be made.

Figure 8:
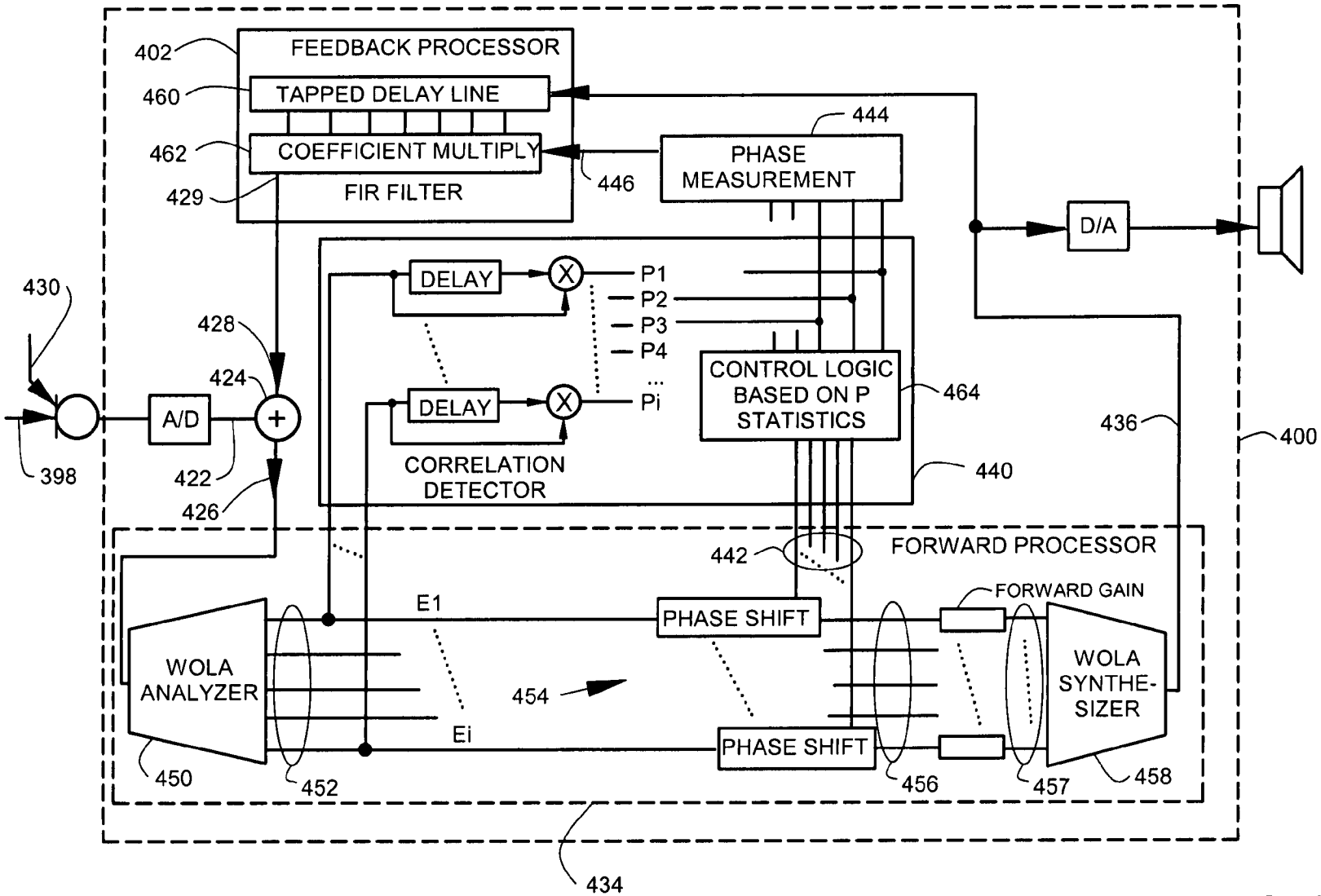
FIG. 8 illustrates a block diagram of a third embodiment of a hearing aid circuit that includes an adjustable internal feedback path controlled by an SPM algorithm.

FIG. 8 illustrates a block diagram of a third embodiment of a hearing aid circuit 400 that includes an adjustable internal feedback path controlled by an SPM algorithm. The hearing aid circuit 400 is preferably realized using a Toccata digital signal processor available from dspfactory, Ltd., 611 Kumpf Drive, Unit 200, Waterloo, Ontario, N2VIK8, Canada. Other digital signal processors can be used as well.

The hearing aid circuit 400 comprises a summing circuit 424 that receives an audio output 422. The audio output 422 includes audio from a sound source 398 and audio from audio feedback 430 received from a receiver via an external feedback path (not illustrated). The summing circuit 424 also has a second summing input 428 and a net sum output 426.

A forward processor 434 receives the net sum output 426 and provides a processed output (feedforward output) 436. The forward processor 434 includes a Weighted Overlap-Add (WOLA) analyzer 450 that receives the net sum output 426. The WOLA analyzer 450 provides multiple output lines E1, E2, E3 . . . Ei at 452 that reproduce the net sum output separated into i frequency bands (frequency components). The outputs E1, E2, etc. comprise vector representations that include amplitude and phase angle information. Details of the WOLA are published by dspfactory, mentioned above. The multiple output lines 452 are coupled to i controllable phase shift circuits 454, with one phase shift circuit for each frequency band. Each of the multiple phase shift circuits 454 is independently controllable to provide a controlled phase shift for a particular frequency band.

Phase shifter outputs 456 are coupled to inputs of the channel forward gain elements. The outputs 457 of gain element connect to the WOLA synthesizer 458. The WOLA synthesizer 458 combines the individual gain element outputs 457 to produce the processed output (feedforward output) 436.

A feedback processor 402 receives the processed output 436 and provides a feedback output 429 to the second summing input 428. The feedback processor 402 comprises a tapped delay line 460 that receives the processed output 436. Outputs or taps of the delay line 460 couple to a coefficient multiplying circuit 462 that provides the feedback output 429. The tapped delay line 460 and the coefficient multiplying circuit 462 together comprise a finite impulse response (FIR) filter. The FIR filter is similar to the circuit described above in connection with FIG. 6.

A correlation detector 440 couples to the forward processor 434 along lines 442 to control the phase shift circuits 454 and provide small phase changes in the processed output 436 as a function of detected correlation in the net sum output 426. The correlation detector 440 includes i autocorrelators (delays and multipliers) receiving the WOLA analyzer outputs 452. The i autocorrelators produce i correlation outputs P1, P2, P3, . . . Pi. The correlation outputs P1, P2, P3 . . . Pi couple to control logic 464 that controls the phase shift circuits 454. the correlation outputs P1, P2, P3, . . . Pi also couple to a phase measurement circuit 444 and serve as a representation of the net sum output separated into individual frequency bands.

The phase measurement circuit 444 measures phase change in the net sum output 426 (by sensing correlation output P1, P2, P3 . . . Pi that include filtered net sum output data) and provides a phase measurement output 446 that makes an adjustment of the feedback processor 402. The adjustment reduces net feedback at the net sum output 426. The net feedback is the sum of feedback output 429 and audio feedback 430 at the net sum output 426. The phase measurement circuit 444 can sense phase change in the net sum output 426 by a direct connection to the net sum output 426, or alternatively, the phase measurement circuit 444 can be connected to the correlation outputs P1, P2, P3, . . . Pi of the correlation detector 440 in order to measure phase change on a filtered version of the net sum output 426 as it appears at the outputs P1, P2, P3 . . . Pi of the correlation detector 440. The phase measurement circuit 444 functions to measure the phase at the input. Phase measurement timing is synchronized with the insertion of phase changes on lines 456. The phase at the input of phase measurement circuit 444 is preferably measured after a delay about equal to the loop delay. If there is no input phase change in response to the output change then there is no net hearing aid feedback. If there is an input phase change, the direction and magnitude of the phase change indicates how the FIR filter coefficients 462 should be changed to minimize the net hearing aid feedback.

The forward processor 434 preferably comprises phase shifters 454 coupled to the correlation detector 440 along line 442. The phase shifter provides the small phase change in the processed output 436.

The WOLA circuits 450, 458 function to divide the incoming signal into frequency sub bands and then recombine them. This is very computationally efficient for the SPM algorithm that is used in FIG. 8. Algorithms, such as the SPM algorithm work efficiently on distinct frequency bands.

The correlation detector functions by comparing an incoming signal 452 with a delayed version of the incoming signal. When the average of the product of the input with the delayed input is high then there is a high correlation. The delay in the correlation detector corresponds approximately to the total delay around the forward and feedback loop. Typically this is about 6 millisecond delay through the forward processor and a 1 millisecond delay through the external feedback path.

The correlation for the hearing aid circuit 400 uses a calculation similar to Equation 3, but performs the calculation for each frequency band i according to Equation 5:

$$P_i(n)=E_i(n)\cdot E_i^*(n-m) \qquad \text{Equation 5}$$

Where:

$P_i(n)$ is the correlation product $E_i(n)$ is WOLA output 452; and m is correlation delay.

The hearing aid circuit 400 provides efficient band filtering so that there is a correlation function for each band of interest. Since the outputs of the filter banks in the WOLA analyzer 450 are complex numbers, the product in the above formula uses the complex conjugate for the second term (i.e. E*(n−m)). In a preferred arrangement, the averaging calculates the standard deviation of $P_i(n)$ for 16 input samples (n's). This value is then compared to the mean value of $P_i(n)$ for the same 16 samples. If the standard deviation is greater than 0.7 of the mean then the correlation is determined to be "low". In a preferred embodiment, a deviation-to-mean ratio in the range of 0.25 to 1.0 is used as a threshold.

If correlation is low then the input is relatively "random", meaning that there is no hearing aid feedback oscillation and no periodic signal source present. For low correlation, the circuit can revert to the LMS algorithm with a relatively low convergence speed, since there is no actual oscillation.

If the correlation is high it means that there is periodic or nearly periodic input. This input can be the result of either a true periodic sound source or it could also result from feedback oscillation. The correlation detector will show a high level in both cases but does not distinguish between the two.

Figure 9:
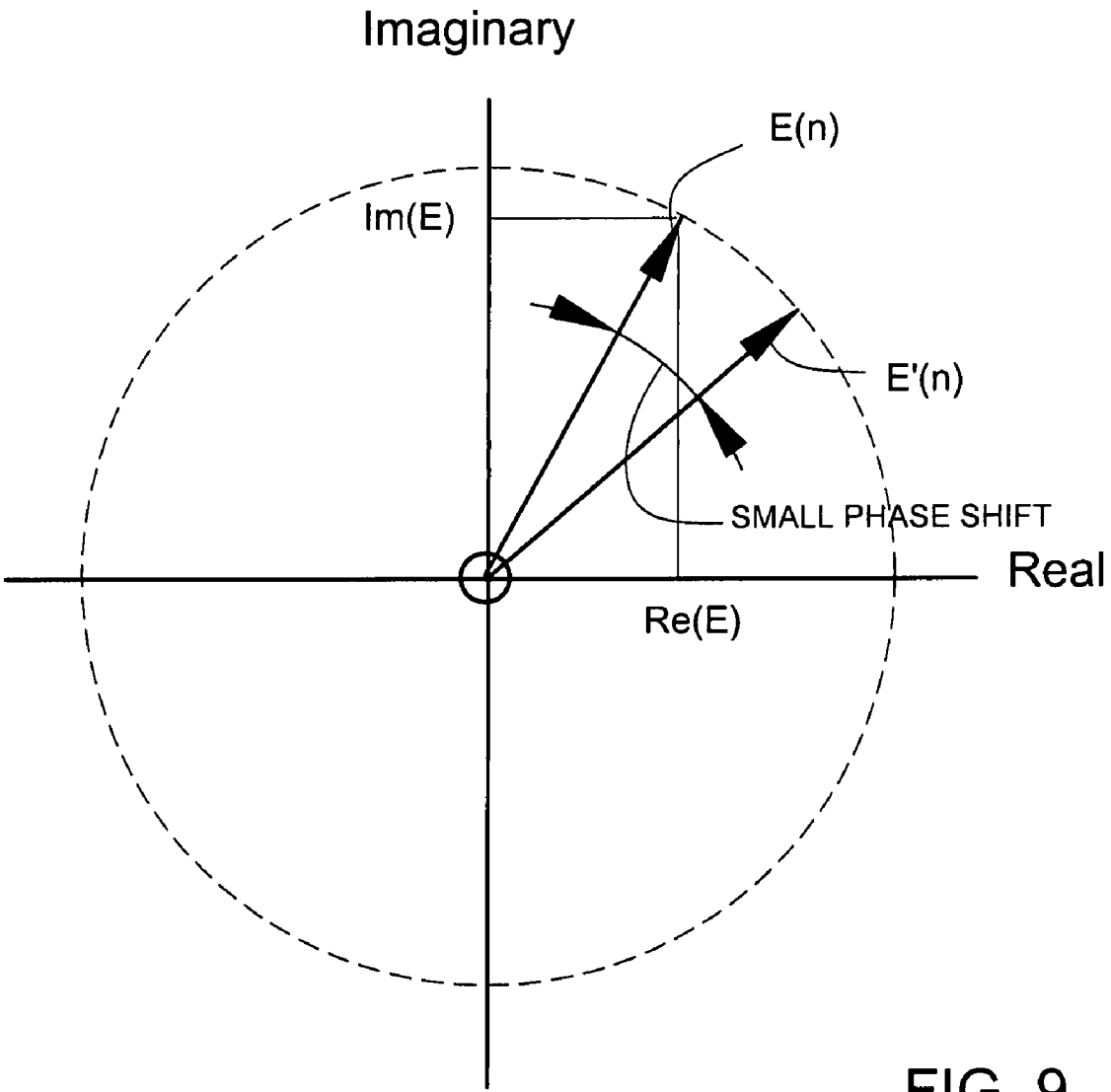
FIG. 9 illustrates an example of a phase shifter for the hearing aid circuit shown in FIG. 8.

Resolving the uncertainty when the correlation is high is accomplished by applying a phase shift in the forward path. FIG. 9 illustrates the operation of a phase shifter useful with the WOLA implementation shown in FIG. 8. The signals E1 . . . Ei are resolved into a vector form of real (Re(En)) and imaginary (Im(En)) components by the WOLA analyzer 450 in FIG. 8. In the real/imaginary (transform) plane illustrated in FIG. 9, a phase shift can be accomplished by rotating the E(n) vector in the transform plane to a new position E'(n). The phase shifter can simply accomplish this rotation using multiplication of E(n) by COS(b)+jSIN(b) where b is the rotation angle. Typical phase shifts that can be used are those shown in FIG. 4.

Figure 10:
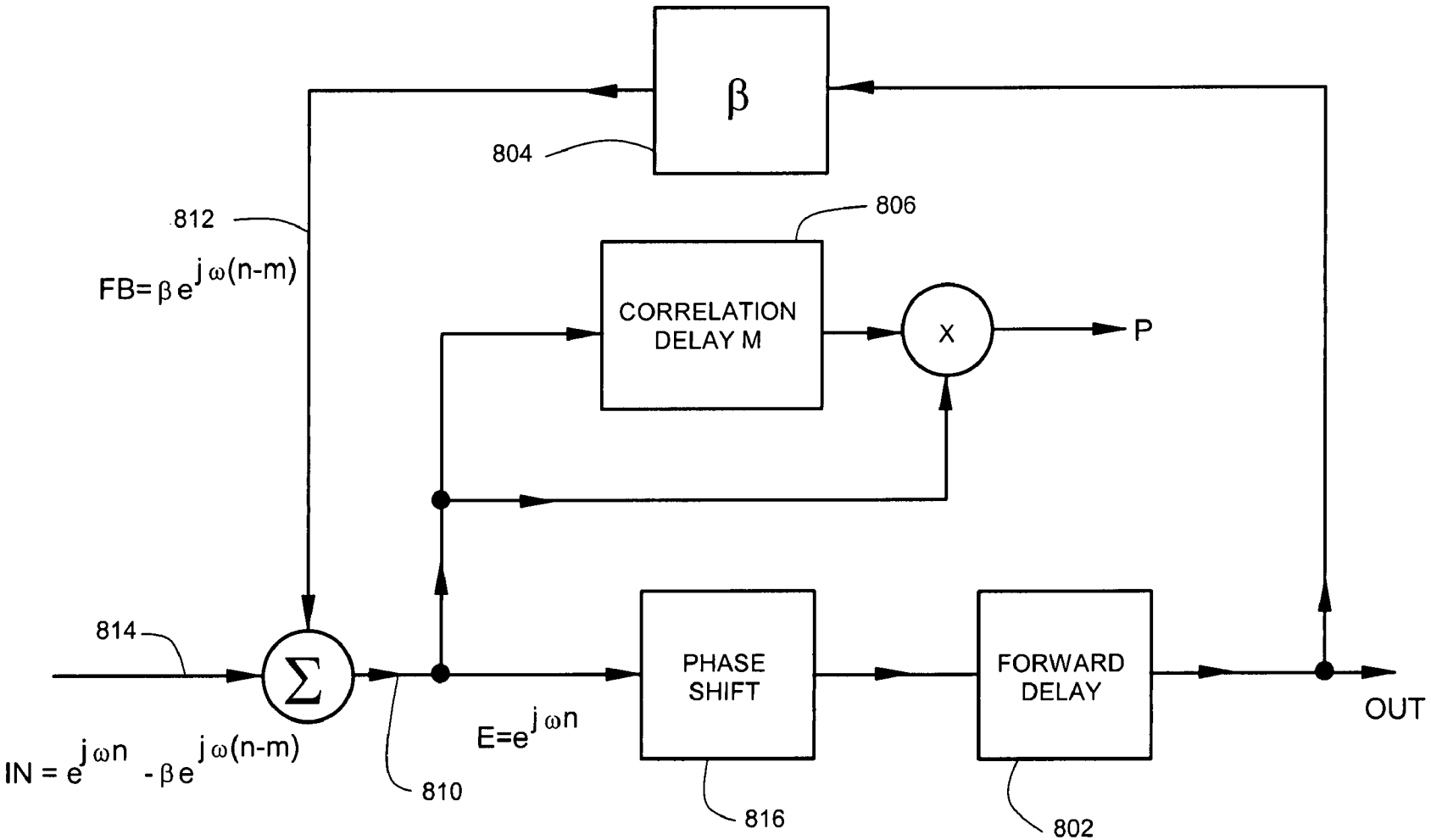
FIG. 10 illustrates a simplified schematic of a phase measurement circuit.

The performance of the phase measurement circuit 444 and the logic to appropriately adjust the feedback processor 402 in response to that measurement can perhaps best be explained by the use of the simplified schematic shown in FIG. 10. FIG. 10 is comparable to the embodiment as FIG. 8 but with only one channel (for one frequency band) shown, the forward processor simplified to a simple delay 802 and the external feedback and the internal feedback paths combined. The combination of the two feedback paths is shown as one feedback element 804 with a gain of β. Since one the two feedback paths is external and unknown then the combined path is also unknown (i.e. β is unknown). If the internal feedback processor 402 perfectly cancels the external path then β=0. If β=1, oscillation will occur. Generally β is complex number where $|\beta|\leqq 1$. If β can be determined then the feedback processor can be adjusted to reduce it. The correlation delay (m) 806 is set equal to the forward delay 802.

To understand the SPM algorithm in this embodiment consider the simplified situation where the signal E(n) at 810 is a complex sinusoid $E(n)=e^{j\omega n}$. Since the WOLA filters the inputs into narrow frequency bands, this approximation in FIG. 10 is fairly accurate for periodic or nearly periodic inputs. With this approximation for E(n) and for the feedback path β, the feedback signal FB 812 is $$FB(n)=\beta e^{j\omega(n-m)}$$

and the true signal input 814 is $$In(n)=e^{j\omega n}-\beta e^{j\omega(n-m)}.$$

Substituting E(n) into Equation 5 one can easily calculate that $$P(n)=e^{j\omega m}.$$

Since m is the fixed length of the correlation filter, one sees that P(n) here is a fixed number that does not change with n. Hence the correlation detector which averages the P's over n, will see a high correlation.

In response to the high correlation the small phase change (Δφ) of FIG. 4A is applied by the phase shift circuit 816. After the forward delay time of 320, the E(n) signal has changed to $$\tilde{E}(n)=\beta\cdot e^{j\omega(n-m)}\cdot e^{j\Delta\phi}+e^{j\omega n}-\beta\cdot e^{j\omega(n-m)}$$

where $\tilde{E}(n)$ indicates E(n) between time 318 and 319 of FIG. 4A.

Since the phase change has not had time to propagate through the correlation delay E(n−m) is still $\tilde{E}^*(n-m)=e^{j\omega(-n+m)}$.

Substituting into Equation 5 gives:

$$\tilde{P}(n)=\beta\cdot e^{j\omega(n-m)}\cdot e^{j\Delta\phi}\cdot e^{j\omega(-n+m)}+e^{j\omega n}\cdot e^{j\omega(-n+m)}-\beta\cdot e^{j\omega(n-m)}\cdot e^{j\omega(-n+m)}$$

Simplifying and using the approximation $e^{j\Delta\phi}\approx 1+j\Delta\phi$ gives:

$$\tilde{P}(n)\approx\beta\cdot j\cdot\Delta\phi\cdot e+e^{j\omega m}$$

Then the quantity ΔP is calculated $$\Delta P\equiv\tilde{P}(n)-P(n)=\beta\cdot j\cdot\Delta\phi \qquad \text{Equation 6}$$

Equation is 6 is very valuable since it shows that by calculating the function ΔP the value of β can be obtained. Note that the β can be obtained even when the true signal source is sinusoidal, something that is not possible with any of the normal LMS designs. Note also that equation 6 shows that the value of β can be obtained in only one application of the phase shift. This would theoretically allow a perfect feedback correction in only one application. In practice, however, the correction is typically done iteratively over several applications of the phase shift. This prevents sudden changes to the feedback processor that could give audible artifacts.

The phase measurement circuit 444 of FIG. 8 works along the principles described in Equation 6 and the preceding calculations. The calculations of β are done for each of the frequency channels of the WOLA. There are enough channels and the external feedback frequency shape smooth enough that the series of β's is able define the internal feedback processor 402 quite well.

The internal feedback processor 402 is adjusted based on the results of the phase measurement. The details of the adjustment depend on the specific implementation used for the feedback processor. One possible implementation is a feedback processor constructed as a sum of band pass filters, where the band widths match the WOLA frequency bands. Both the phase and the magnitude of the filter outputs are adjustable. With such a design the β's calculated above for each WOLA frequency band could be used to adjust the corresponding frequency band of the feedback processor. The exact correspondence of the adjustment of the feedback filter could be determined empirically to give convergence of the cancellation. Typically one would like the convergence speed to correct for changes with a time constant of about 50 to 300 milliseconds.

A second example of the feedback processor 402 is the tapped delay line of FIG. 6. This design is preferred over the first example because it is a simpler filter design, but it has the disadvantage that it is not organized into specific frequency bands. This short coming can be overcome by organizing the updates of the coefficients into grouping that effect one particular frequency band. Further simplification of the update process can be accomplished by picking the particular β with the highest magnitude, then select whether the real or imaginary component is the largest. This can then be used to select a particular set of small coefficient updates to be added or subtracted from the FIR coefficients. Whether to add or subtract the updates is determined by the sign of the largest β component.

As an example, a 32 tap FIR filter is sampled at 16 kHz. The coefficient updates are organized into 16 filter bands centered at 0, 0.5, 1.0 . . . 7.0, 7.5 kHz. For each band there are two sets of coefficients a(n), b(n) that differ by 90 degrees. For the above example at 4 kHz, one set of coefficients is:

$$a(i)=\mu\cdot\mathrm{COS}\left(2\pi\cdot i\cdot\frac{4\text{ kHz}}{16\text{ kHz}}+\theta\right) \qquad \text{Equation 7}$$

for $i=0, 1, \ldots 31.$

The other set of coefficients for 4 kHz is:

$$b(i)=\mu\cdot\mathrm{SIN}\left(2\pi\cdot i\cdot\frac{4\text{ kHz}}{16\text{ kHz}}+\theta\right) \qquad \text{Equation 8}$$

for $i=0, 1, \ldots 31.$

The update to the FIR coefficients is then accomplished by adding or subtracting the appropriate a(i) or b(i), as determined by the phase measurement, to the ω(i). θ and μ are chosen experimentally to give the optimum convergence.

A third example of how the feedback processor could be designed is slightly different than in FIG. 8. The feedback processor in FIG. 8 is outside the WOLA processor. The third implementation example would have a feedback processor for each band and for these to connected inside the WOLA. These processors would have signal lines 457 as inputs and summing circuit 424 moved in series with lines 452. The inputs to the summers would be the WOLA analyzer outputs 452 and the feedback processor. The summer output would be the input to the phase shifters. This implementation has the advantage that the phase measurements, which are specific to a particular WOLA band, could be applied directly to the feedback processor that is specific to that band.

One advantage of the implementation of FIG. 8 is that it allows the simple option of performing the feedback cancellation preferentially for some frequency bands over other frequency band. For example, there is insignificant external feedback at lower audio frequencies for most hearing aid applications. Therefore it be possible to use phase shift circuits 454, correlation detectors 440 and phase measurement circuits 444 on only the higher audio frequency bands and not on the lower audio frequency bands.

Although the present invention has been described with reference to preferred embodiments, workers skilled in the art will recognize that changes may be made in form and detail without departing from the spirit and scope of the invention.

What is claimed is:

1. A hearing aid circuit that provides amplification along a feedforward path in an environment subject to hearing aid feedback, the hearing aid circuit comprising:

a phase shifter that is in the feedforward path and that has a phase shifter input, a phase shifter output and a control input, the phase shifter introducing a temporary phase shift for a time duration along the feedforward path;

a summing junction that provides a summing junction output that couples to the phase shifter input;

a correlation detector that detects correlation at the feedforward path and that provides a correlation output to the control input;

a phase measurement circuit measuring a measured phase shift along the feedforward path in response to the temporary phase shift, the phase measurement circuit providing a phase measurement output; and an internal feedback processor that receives the phase measurement output, the internal feedback processor adjusting internal feedback coupled to the summing junction as a function of the phase measurement to suppress coupling of the hearing aid feedback along the feedforward path.

2. The hearing aid circuit of claim 1 wherein the temporary phase shift comprises a continuously running phase shift variation.

3. The hearing aid circuit of claim 1 wherein the phase shifter provides a small phase change as a function of the detected correlation.

4. The hearing aid circuit of claim 1 wherein the phase measurement circuit couples to a correlator output for measuring the phase change.

5. The hearing aid circuit of claim 1 where the correlation detector, the phase shifter and the phase measurement circuit are implemented in a digital signal processing circuit.

6. The hearing aid circuit of claim 1 wherein the temporary phase shift is less than ninety degrees.

7. The hearing aid circuit of claim 1 wherein the temporary phase shift is approximately twenty degrees.

8. The hearing aid circuit of claim 1 wherein the temporary phase shift has a noninterfering amplitude that is small enough so that the temporary phase shift does not interfere with positive feedback around a loop comprising the feedforward path and a path of the external audio feedback.

9. The hearing aid circuit of claim 1, further comprising:

a summing circuit that receives an audio output including audio from a sound source and audio feedback, the summing circuit having a second summing input and a net sum output.

10. The hearing aid circuit of claim 9 wherein the phase measurement circuit couples directly to the net sum output for measuring the phase change.

11. The hearing aid circuit of claim 9 wherein a correlation detector detects autocorrelation at the net sum output.

12. The hearing aid circuit of claim 1 wherein the forward path comprises a WOLA analyzer and a WOLA synthesizer.

13. The hearing aid circuit of claim 1 wherein the feedback processor comprises a FIR filter.

14. A method for reducing hearing aid feedback in a hearing aid circuit, comprising:

introducing a temporary phase shift for a time duration along a feedforward path as a function of correlation at a feedforward path input;

providing a summing junction that couples a summing junction output to a feedforward path input;

providing control of the temporary phase shift as a function of correlation detected at the feedforward path;

measuring a measured phase shift in response to the temporary phase shift at the feedforward path input, and providing a phase measurement output; and receiving the phase measurement at an internal feedback processor, the internal feedback processor adjusting internal feedback coupled to the summing junction as a function of the phase measurement to suppress coupling of the hearing aid feedback along the feedforward path.

15. The method of claim 14, wherein the temporary phase change is less than ninety degrees.

16. The method of claim 14, wherein the temporary phase change is approximately twenty degrees.

17. The method of claim 14, comprising:

coupling the phase measurement circuit to a correlator output for measuring the measured phase change.

18. A hearing aid circuit that provides amplification along a feedforward path in an environment subject to hearing aid feedback, the hearing aid circuit comprising:

phase shifter means for introducing a temporary phase shift for a time duration along the feedforward path as a function of correlation at a feedforward path input;

a summing junction that provides a summing junction output that couples to the phase shifter means;

a correlation detector that detects correlation at the feedforward path and that provides control of the phase shifter means as a function of the detected correlation;

phase measurement means for measuring a measured phase shift in response to the temporary phase shift at the feedforward path input, the phase measurement means providing a phase measurement output; and an internal feedback processor that receives the measured phase measurement output, the internal feedback processor adjusting internal feedback coupled to the summing junction as a function of the phase measurement to suppress coupling of the hearing aid feedback along the feedforward path.

* * * * *

UNITED STATES PATENT AND TRADEMARK OFFICE

CERTIFICATE OF CORRECTION

PATENT NO. : 7,519,193 B2
APPLICATION NO. : 10/931683
DATED : April 14, 2009
INVENTOR(S) : Fretz It is certified that error appears in the above-identified patent and that said Letters Patent is hereby corrected as shown below:

Column 11,
Line 65, after Equation 5: insert --$P_i(n) = E_i(n) \bullet E_i^*(n-m)$--.

Column 13,
Line 37, after Equation delete "is".

Signed and Sealed this

Twenty-first Day of July, 2009

John Doll

JOHN DOLL
*Acting Director of the United States Patent and Trademark Office*